US005401027A

United States Patent [19]

Surbeck

[11] Patent Number: 5,401,027

[45] Date of Patent: Mar. 28, 1995

[54] GOLF GAME

[76] Inventor: David M. Surbeck, 12511 Lantana Ct., Etiwanda, Calif. 91739

[21] Appl. No.: 197,706

[22] Filed: Feb. 17, 1994

[51] Int. Cl.[6] ..... A63B 69/36

[52] U.S. Cl. ..... 273/181 R; 273/DIG. 21

[58] Field of Search ..... 273/181 R, 181 A, 176 B, 273/DIG. 21, 35 R

[56] References Cited

U.S. PATENT DOCUMENTS 3,459,429 8/1969 Green ..... 273/DIG. 21
3,490,769 1/1970 Torbett ..... 273/181 R
3,985,359 10/1976 Moore ..... 242/118.4 X
4,171,134 10/1979 Reck ..... 273/181 R

*Primary Examiner*—George J. Marlo
*Attorney, Agent, or Firm*—Boniard I. Brown

[57] ABSTRACT

A lawn game is provided in which plastic golf balls are struck with plastic golf clubs at a target. Surrounding the target is a plurality of rings of varying size. Each ring is made up of a flexible length of tubing having opposite ends. The opposite ends can be connected together to transpose the length of tubing into a ring. The lengths of tubing can also be connected together with the other lengths of tubing to form a long length of tubing. This long length of tubing is conveniently rolled up and stored on a take-up reel.

8 Claims, 5 Drawing Sheets

GOLF GAME

BACKGROUND OF THE INVENTION

Backyard golf games and other similar lawn games, wherein the object is to propel a projectile as near as possible to a target marker, are in common usage. Such games provide a pleasant form of family entertainment. They are relatively easy to set up and generally can be played by young and old alike.

Because it is relatively rare to score a direct hit on the target marker, most games provide some form of scoring system based upon how close a player gets the projectile to the target marker. One simple and effective method of providing such a scoring system is to surround the target marker with a number of concentric rings. In such a game, a projectile which comes to rest within a certain ring is assigned a higher score than a projectile which comes to rest outside the ring. For a standard size backyard, such concentric rings must be fairly large to form a proper target area. A typical set of rings will have individual rings which range in size from a diameter of about three feet up to a diameter of perhaps ten feet.

Unfortunately, such large rings are awkward and difficult to store when the game is not in use.

Target games involving successively larger target rings have been proposed in prior patents. U.S. Pat. No. 4,171,134 to Reck discloses a target game wherein the primary target is a flag having a flagstick extending downwardly into a hollow stake adapted to be embedded in the ground. The Reck game arrangement requires that only circular concentric rings of varying diameter be placed about the flag to provide target zones of varying point values. A light weight practice golf ball is used with a standard golf club to test a player's proficiency in hitting the flag or landing the ball in the surrounding target zones. The circular rings are formed by one or more lengths of plastic tubing placed on the ground surface about the flagstick. As shown in the drawing of the patent, the smallest diameter ring is formed by a single length of plastic tubing having its ends inserted into a special clamp. FIG. 2 best illustrates the clamp construction. The larger rings are formed by two or more lengths of plastic tubing connected together by special clamps of the type shown in FIG. 2.

In addition to the problem of requiring only concentric circular rings, a problem with the Reck target game is that it would be difficult to store the plastic tubing of the target rings. The individual plastic tubes are too long for convenient storage. For example, with a target ring having a diameter of ten feet and comprised of three plastic tubes, each tube would have a length in excess of ten feet, thus presenting a storage problem.

U.S. Pat. No. 3,985,359 to Moore discloses a badminton or volley ball court defined by interconnected sections of twine integrally joined together at preselected points to form boundary lines and court separation lines when laid in rectangular configuration on a ground surface. The twine assembly is storable on a portable reel that has three separate reel sections adapted to receive different twine sections representing parallel lines on the court, thus to prevent the twine sections from becoming entangled while on the reel, whereby when the twine assembly is unwound from the reel the twine sections will have approximately their final configuration on the ground surface. The reel construction depicted of Moore is a small diameter structure not adapted to accommodate plastic tubing of the type contemplated in the Reck patent. The Moore reel does not represent a solution to the tubing-storage problem associated with the target game of the Reck patent.

Accordingly, there is a need for a lawn game which comprises a number of concentric target rings, and wherein such rings are compactly, easily and inexpensively stored.

SUMMARY OF THE INVENTION

The present invention satisfies this need.

The invention is a lawn game, the object of which is to propel a projectile as close as possible to a target. The game comprises a target, a projectile, and a plurality of flexible elongated members of differing lengths. One end of each elongated member can be attached to the opposite end of the member to form a continuous .target area-defining ring adjustable to any selected configuration. Also, each end of each elongated member can be attached to at least one end of another elongated member. This feature allows for the elongated members to be joined to each other, end-to-end, to form a single, more elongated member adjustable to selected configuration.

The invention further comprises a take-up reel having a frame and a revolving drum and connection means for connecting one of the ends of the more elongated member to the drum so that the more elongated member can be wound about the drum for compact and easy storage.

In one embodiment, the elongated elements are hollow tubes. One end of each hollow tube has a male projection which press fits into a corresponding female connector at the opposite end.

In a preferred embodiment, the elongated members are of differing colors so that rings formed by each elongated member stand out visually with respect to one another.

In another preferred embodiment of the invention, the projectile is a golf ball and the target is a small flag. This embodiment further comprises one or more golf clubs and a golf tee-off square. A player places the golf ball on the tee-off square and strikes the ball with the golf club while aiming at the flag. The player's score is computed based upon whether or not the ball comes to rest within one of the concentric rings formed by the elongated members and disposed about the target. The player receives a relatively higher score for placing the ball within a smaller ring.

The invention provides a compact, easy and inexpensive way to store the concentric rings used in the game. Each of the rings can be disassembled and connected end-to-end with the other rings to form a single very elongated member. This very elongated member is then attached to the drum of the take-up reel and wound onto the drum for convenient storage.

BRIEF DESCRIPTION OF THE DRAWINGS

The invention is further described with reference to the accompanying drawings, wherein.

DESCRIPTION OF PREFERRED EMBODIMENTS

Figure 1:
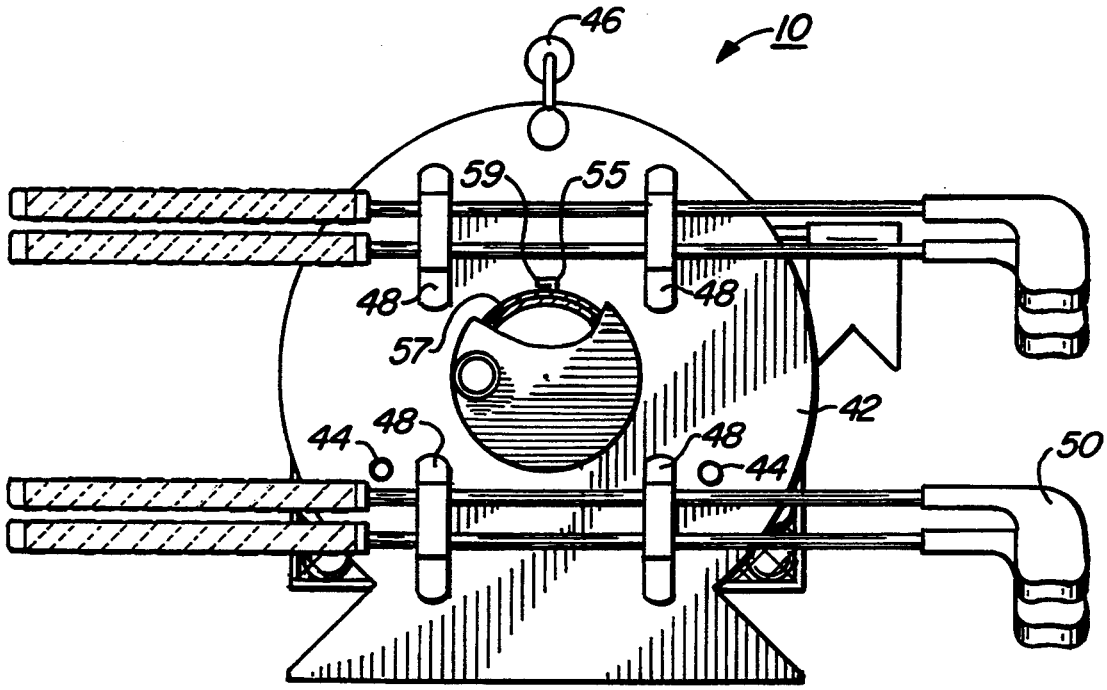
FIG. 1 is a side view of a golf game having features of the invention.
Figure 2:
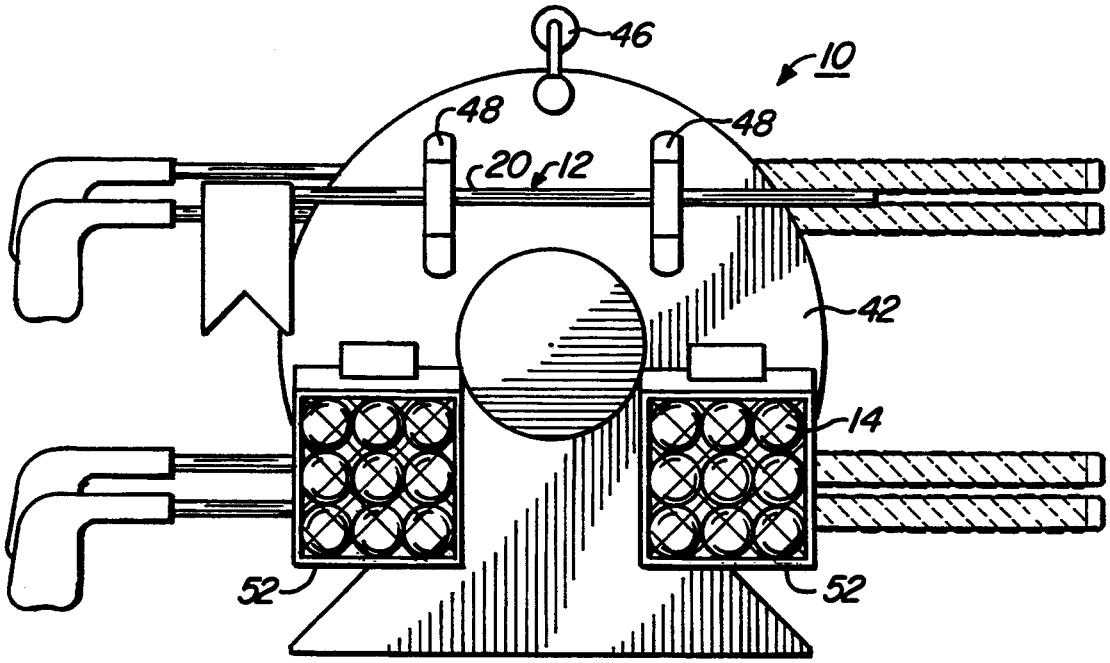
FIG. 2 is an opposite side view of the golf game shown in FIG. 1.

The following discussion describes in detail one embodiment of the invention and several variations on that embodiment. This discussion should not be construed as limiting the invention to that particular embodiment or to those particular variations. Persons skilled in the art will recognize numerous other embodiments and variations as well. For definition of the complete scope of the invention, reference is made to the appended claims.

Referring to the drawings, the lawn game of the invention 10 comprises a target 12, a projectile 14, a plurality of flexible elongated members 16, and a take-up reel 18.

The target 12 can be any relatively small object capable of withstanding the wear and tear caused by being struck by the projectile 14. In the embodiment illustrated in the drawings, the target 12 is a small flag 12 having a flag staff 20 capable of being partially embedded into the lawn. In another embodiment, the target may be a cup (not shown) capable of being embedded into the ground. Such cup may also have at its base a centralized opening capable of receiving the lower end of a flag staff 20.

The projectile 14 can be any small object capable of being propelled at the target 12. Balls may be used as projectiles as can numerous other small objects such as horseshoes, darts, shuttlecocks, gliders, bean bags, etc. For the golf game illustrated in the drawings, the projectile is a golf ball 14. For purposes of this application, the term "golf ball" means any dimpled, spherical ball resembling a tournament golf ball. The golf ball 14 can be made from any suitable material, such as a plastic, rubber, leather, etc. For small backyard games, a golf ball 14 made from a light, resilient plastic is preferred. Golf balls 14 made from such a material are heavy enough to be projected the length of an average yard, but light enough and resilient enough to cause minimum damage to persons or property should the ball 14 be projected errantly.

The elongated members 16 can be made from a variety of flexible, resilient materials. Plastics and rubbers can be used. The elongated tube members 16 may be of any cross-section. For ease of manufacture, circular cross-sections are preferred. The elongated members 16 may be solid, but to minimize weight and cost of manufacture, the elongated members 16 are preferably hollow tubes.

The elongated tube members 16 have a first end 22 and a second end 24. The first end 22 of each of the elongated members 16 is substantially identical to the first ends 22 of each of the other elongated members 16. Likewise, the second end 24 of each elongated member 16 is substantially identical to the second end 24 of each of the other elongated members 16.

Attachment means are provided for attaching a first end 22 of an elongated tube member 16 to a second end 24 of an elongated tube member 16. Such attachment means allows the first end 22 of an elongated member 16 to be attached to its corresponding second end 24 to form a continuous ring structure 27. Such attachment means also allows the several elongated tubular members 16 to be assembled end-to-end to form a single elongated tubular member 26. In the embodiment shown in FIG. 7, the attachment means is provided by a male plug-like projection 28 affixed at the first end 22 of the elongated member 16 and a corresponding circular opening 30 at the second end of the elongated member 16. The male projection 28 is dimensioned to press fit into the circular opening 30 so as to form a relatively secure but easily detachable connection. In the embodiment shown in FIG. 8, the attachment means is provided by a connector plug 32. Connector plug 32 has ribbed side surfaces and opposing ends 34 and 38. In the embodiment illustrated in FIG. 8, the first end 34 of the connector plug end 32 is adapted to press fit into a first end 22 of an elongated tubular member 16, and the second end 36 of the connector plug is adapted to press fit into a second end 24 of an elongated tubular member 16. The ribs on the side surfaces of connector plug 32 have an inherently good gripping action on the tube internal surfaces, such that there is a substantial reduced tendency for inadvertent separation of the connected tubes.

Figure 5:
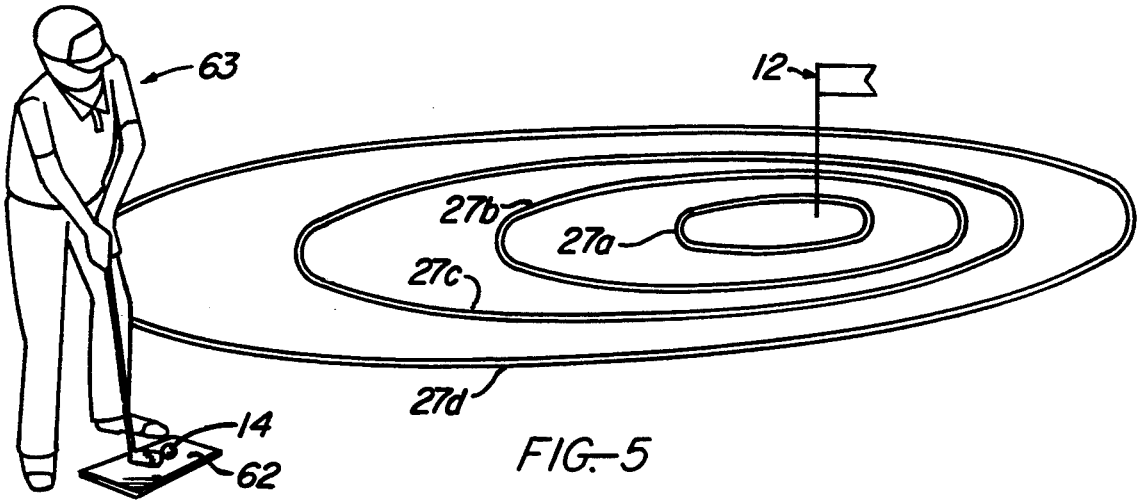
FIG. 5 is a perspective view showing how a golf game having features of the invention may be used or played.
Figure 6:
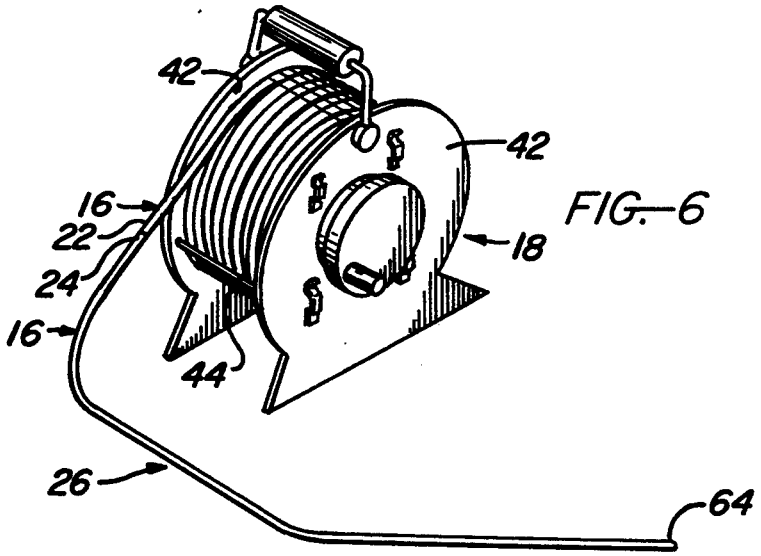
FIG. 6 is a perspective view of a take-up reel useful in the invention showing connected sections of tubing as they may be paid out off the take-up reel.

The elongated tubular members 16, and thus the rings 27, can be of any reasonable dimension. In the embodiment illustrated in FIG. 5, four concentric rings **27*a*, 27*b*, 27*c*, and 27*d* are formed by four different elongated members 16. The rings 27*a–d* are disposed concentrically to form a traditional target-like structure. For embodiments similar to that of FIG. 5, the smallest ring 27*a* may have a diameter between about one foot and about three feet, and the largest ring 27*d* can have a diameter of between about five feet and about fifteen feet. The number of rings 27 is optional. At least three are preferred. The differences in dimensions between the several rings 27 is also optional. Preferably, the rings 27** differ in diameter by at east about one foot.

It should be understood that the elongated members have been described as being assembled into "rings". However, the form of the continuous band created by the joining of the first end 22 and the second end 24 of each elongated member 16 need not be circular. Any other shape may be used.

Preferably, the elongated tubular members 16 are of differing color so that each ring 27 stands out distinctly from the others.

The take-up reel 18 has a frame 38 and a revolving drum 40. In the embodiment illustrated in the drawings, the frame 38 comprises a pair of opposing, vertical side members 42 joined together in spaced-apart relationship by a pair of horizontal rods 44 and a carrying handle 46. Handle 416 comprises a U-shaped bar located directly above the rotational axis of drum 40, whereby the weight of the take-up reel and tubular member 26 is balanced when the reel is carried from one location to another location. The frame 38 comprises a plurality of clips 48 useful in the attachment and support of golf clubs 50 and the flag 12. In the embodiment illustrated in the drawings, the frame 38 further comprises storage containers 52 for retaining golf balls 14. Each container 52 comprises a rigid annular ring and a netting anchored to the ring, whereby a plurality of golf balls may be enclosed within the netting, each ball being visible through the netting.

In the embodiment illustrated in the drawings, the drum 40 comprises a central cylinder section 56, a pair of opposing end caps 58 and a crank knob 60. The end caps 58 press fit over the ends of the central cylinder section 56 to retain the drum 40 within the frame 38. The drum surface is formed of two semicylindrical sheet elements 57 secured to cylinder section 56 by screws or other fastening means. Curved sheet elements 57 increase the drum diameter beyond the diameter of the associated circular holes in side members 42. Sheet elements 57 thus prevent axial play of the drum 40.

Figure 3:
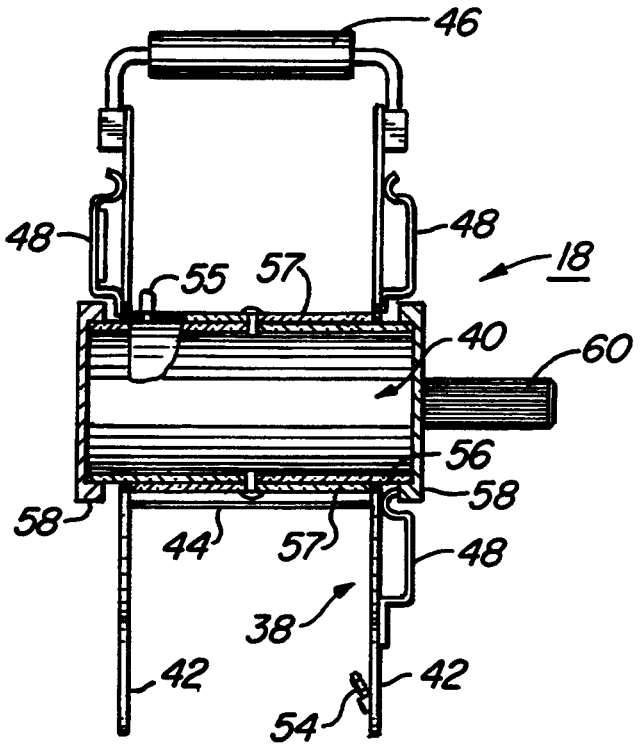
FIG. 3 is an end view of a take-up reel useful in the golf game shown in FIG. 1.
Figure 4:
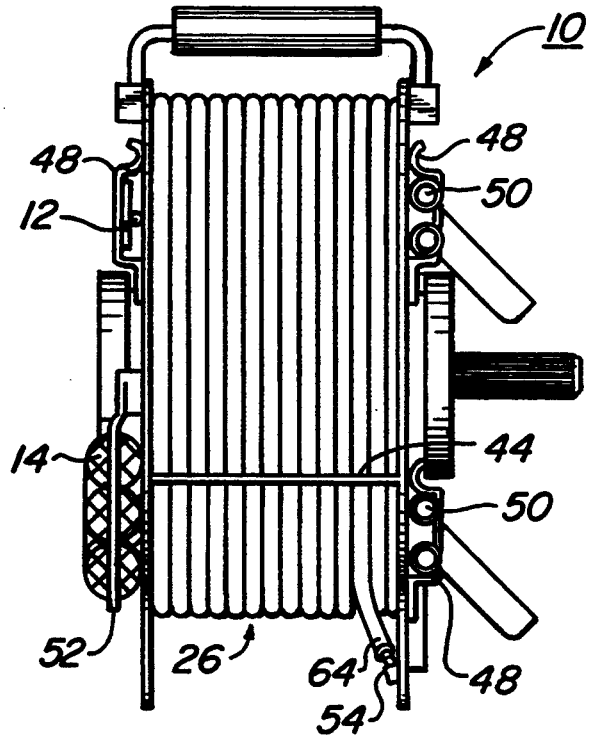
FIG. 4 is an end view of the golf game shown in FIG. 1.

The elongated tubular member 26, comprising tubes 16, is wound on drum 40 for compact storage purposes. One end of the elongated tubular member 26 is attached to the rotary drum by means of a connector 55 extending from the drum surface defined by sheet elements 57. As best seen in FIG. 1, connector 55 comprises a cylindrical plug 59 extending above and along the drum surface, whereby an end of the elongated tubular member 26 can be inserted onto the plug to provide a detachable anchorage of member 26 to the drum. The tubular member 26 lies flat against the drum surface so that it can be readily wound in helical fashion on the drum.. The other end 64 of member 26 (FIG. 4) may be inserted onto a second connector 54 (FIG. 3) projecting from a side member 42.

Tubular members 16 are so constructed and connected that the tube assembly 26 has a smooth outer side surface, without any projections or discontinuities that would interfere with winding on drum 40, or that might cause the individual tubes 16 to become disconnected while on the drum.

Preferably one or both of the end caps 58 is easily detachable from the central cylinder section 56 to allow storage of game pieces within the interior of central cylinder section 56.

In the embodiment illustrated in the drawings, the lawn game of the invention 10 further comprises a set of golf clubs 50 and a tee-off square 62. Where the golf ball 14 is made of a light plastic, the heads of the golf clubs 50 can also be plastic. Other materials can also be used, however, such as metals and woods.

The tee-off square 62 may be of any shape. Preferably, it is made from a flat material with a slight texture such as a rubber, a foamed resilient plastic, or a carpet material. The purpose of the tee-off square 62 is to protect the lawn from divots and to provide a relatively flat surface for teeing-up the ball 14. Preferably, the tee-off square 62 can be partially folded for storing within the central cylinder section 56 of the drum 40.

In operation, a player 63 takes the lawn game 10 illustrated in the drawings and sets it in his backyard. He removes the tee-off square 62 from the central cylinder section 56. He removes a golf club 50 and a golf ball 14 from the side of the take-up reel 18.

He removes the elongated tubular member 26 from the take-up reel 18 by pulling on the free end 64. By this action, the elongated member 26 pays out from the take-up reel 18, rotating the drum 40 as it does so. When the elongated member 26 is fully paid out from the take-up reel 18, the attached end of the elongated member 26 is detached from the drum 40, i.e., from connector 55.

The individual elongated members 16 are separated from one another. Then, the first end 22 of each elongated member 16 is attached to that elongated member's second end 24 to form a ring 27. Because each elongated member 16 differs in length, the several elongated members 16 form rings 27 of differing diameter.

The flag 12 is removed from the take-up reel 18 and is positioned at one corner of the yard by partially embedding the flag staff 20 into the ground. The smallest ring 27 is placed on the ground around the flag 12 with the flag 12 at the ring's approximate center. The other rings 27 are placed around the flag 12 in similar fashion to form a set of concentric rings 27 with the flag 12 at the center.

The player 63 takes the tee-off square 62 to a removed location in the yard and sets it on the ground. He then places a golf ball 14 on the tee-off square 62 and attempts to strike the golf ball 14 with the golf club 50 in such a way that the golf ball 14 is propelled across the yard in the direction of the flag 12. The player 63 will record a relatively higher score by causing the golf ball 14 to come to rest inside the smallest ring 27, and a relatively lower score for causing the ball 14 to come to rest within a larger circle 27 but outside the smallest ring 27.

It should also be noted that, although the use of the rings 27 has been described as forming a layout of concentric circles, the rings 27 may be used non-concentrically as individual target zones or penalty zones.

Figure 7:
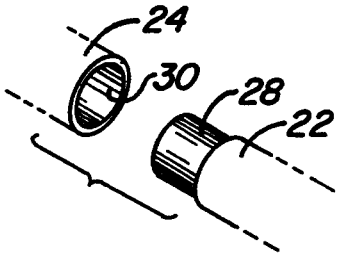
FIG. 7 is a perspective detailed view of a first end of an elongated member useful in the invention juxtaposed with a second end of an elongated member useful in the invention.
Figure 8:
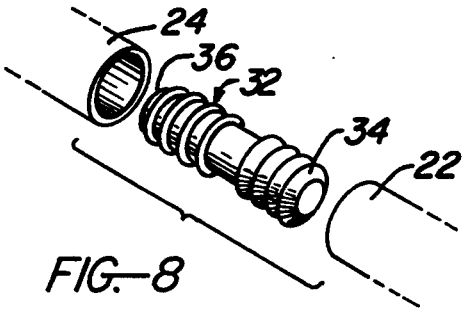
FIG. 8 is a perspective detailed view of a connector plug useful in joining together a first end of an elongated member useful in the invention with a second end of an elongated member useful in the invention.
Figure 9:
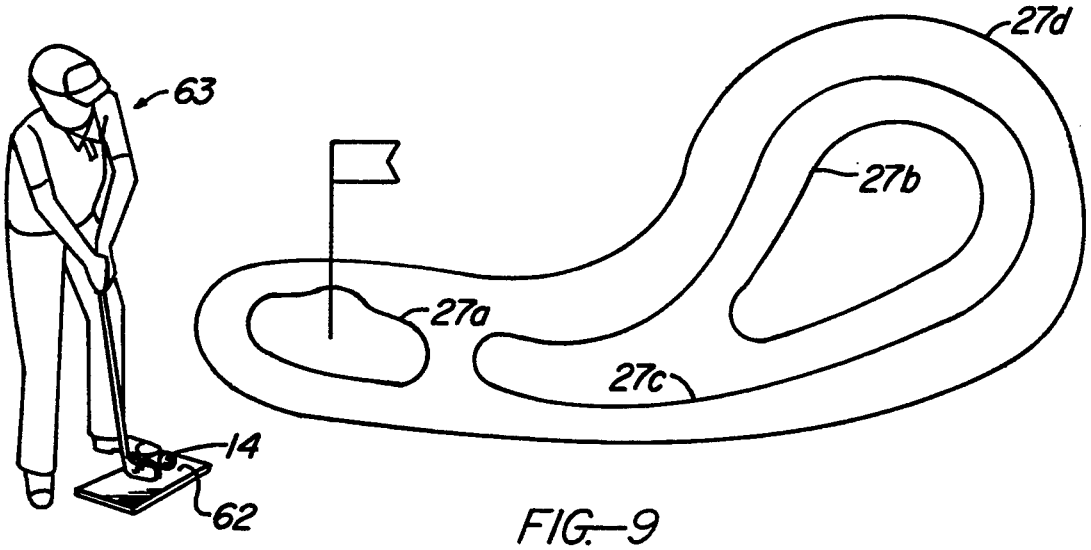
FIGS. 9, 10 and 11 show various target ring arrangements that may be utilized, in addition to the ring arrangement of FIG. 5.
Figure 10:
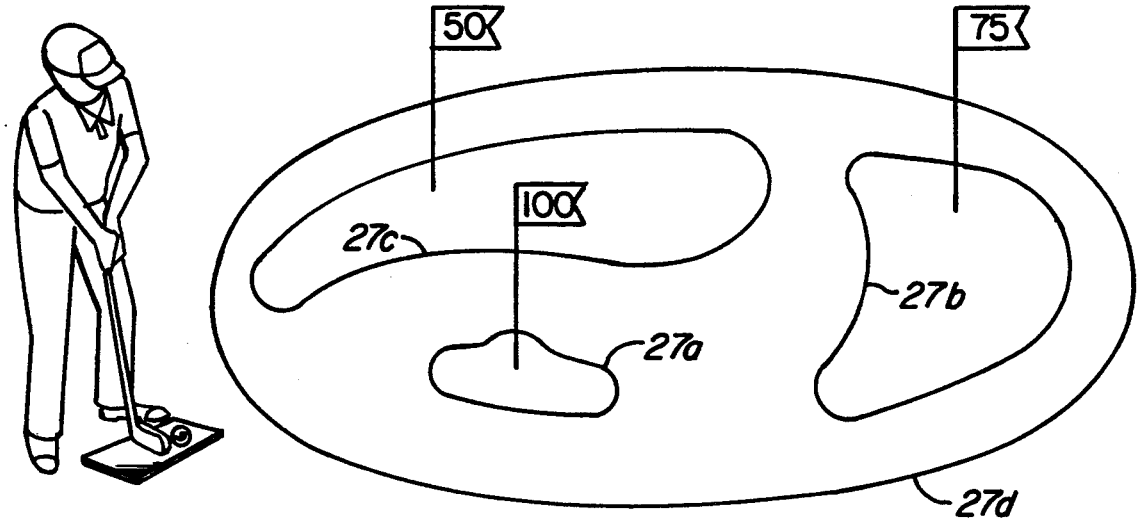
Figure 11:
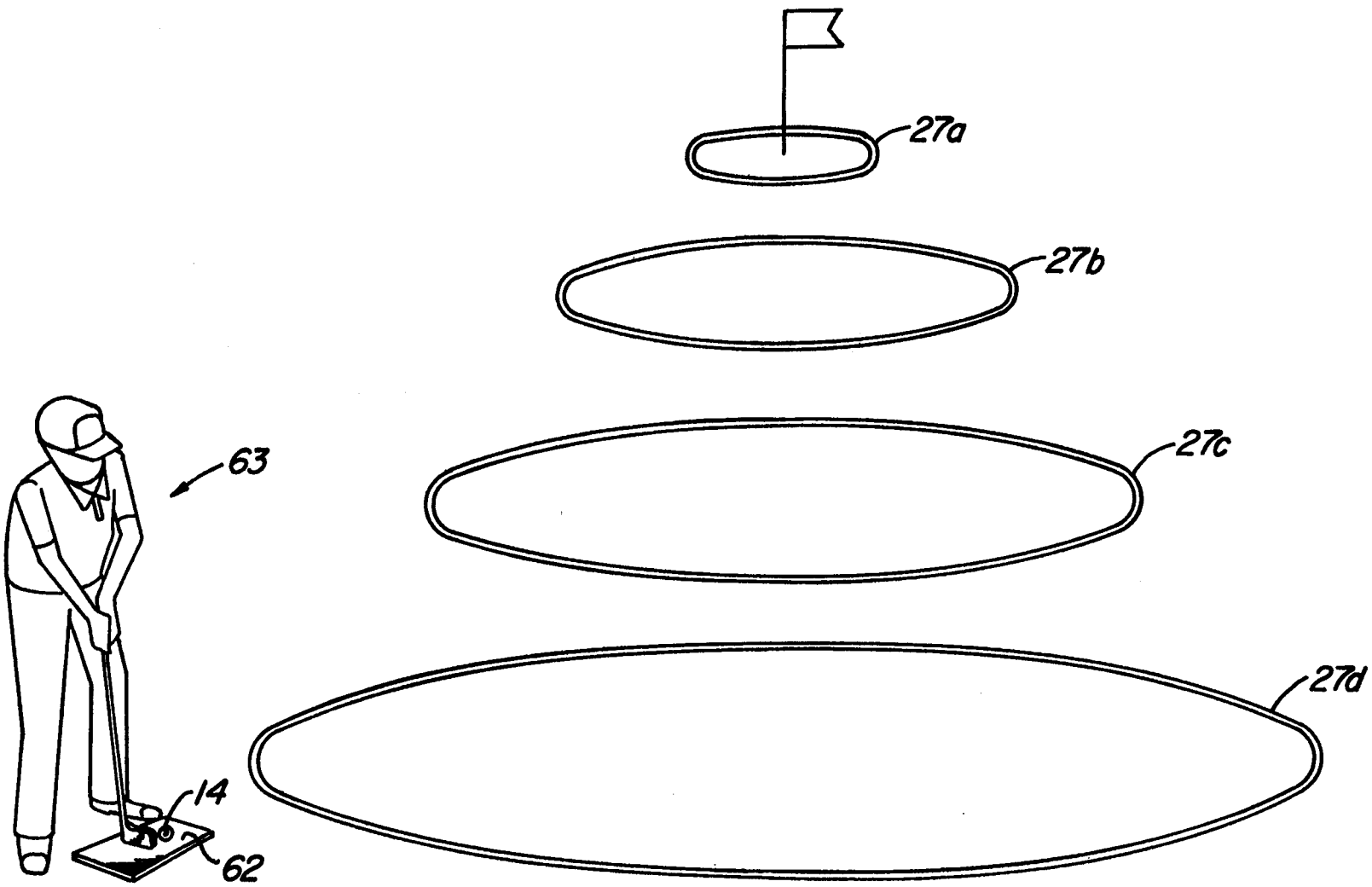

FIGS. 9 to 11 illustrate various alternative ring arrangements that may be employed. FIG. 9 shows four plastic tubes having opposite ends thereof connected together to form rings 27*a*, 27*b*, 27c and 27*d* of varying circumscribed areas and configurations. The different rings may have differing point values. FIG. 10 shows four plastic tube elements formed into rings and arranged differently. Each ring may be marked with a flag having a particular point value thereon, e.g., fifty points, one hundred points, etc., depending on the size of the particular ring. Usually the flag in the smallest ring will have the largest point value. FIG. 11 illustrates a further ring (target) arrangement, wherein the ring furthest from the player is relatively small, and the ring closest to the player is relatively large. In each of the arrangements depicted in FIGS. 9 to 11, each individual ring is formed by one plastic tube element having its opposite ends connected together, as shown in FIG. 7 or FIG. 8.

With any of the above-described ring arrangements, each ring is formed of a single tubular element 16. The size of the completed ring is determined by the length of the respective tubular element 16. Formation of each ring of a single tubular element is advantageous in that it facilitates the ring-formation process. There are a minimum number of connections to be made, and there is no uncertainty on the part of the players as to which tubular elements are intended to form particular rings. This is not the case with the ring construction proposed in the aforementioned U.S. Pat. No. 4,171,134.

Use of a single tubular plastic element 16 to form a given ring is also advantageous in that the tube connections 28, 32 have a lessened tendency to distort the shape of the completed ring. The tube connectors (FIGS. 7 and 8) have some adverse effect on tube flexibility. By minimizing the number of tube connections, adverse effect of connections on tube flexibility is minimized.

When a game is over, the player 63 disassembles each of the rings 27 by separating the first and second ends 22 and 24 of each ring 27. Each of the elongated members 16 is then attached end-to-end to another of the elongated members 16 to form a single, very elongated member 26. One end of the very elongated member 66 is attached to the elongated member drum and the very elongated member 66 is wound onto the drum 40 by rotating the drum 40 using the crank knob 60. The golf ball 14 is replaced into the storage container 52, and the container is attached to the take-up reel via clips 48. The golf clubs 50 are reattached to the take-up reel 18. The flag 12 is attached to the clips 48 on the side of take-up reel 18, and the tee-off square 62 is placed into the central cylinder section 56. Thereafter the end cap 58 is reattached to cylinder 56.

The player 63 then lifts the take-up reel, using the handle and carries the entire compact assemblage back to its storage &tea.

As previously noted, the various plastic tubes 16 are joined together for winding the elongated tube assembly 26 on drum 40. The connections between individual tubes 16 are such that the tube outer surface is smooth and uninterrupted. There are no projections along the tube surface to interfere with trouble-free winding of the tube assembly on drum 40, i.e., undesired separation of the tube elements due to obstructive effects that such projections might produce on the ground surface or on the wound tubing. The connections between individual tubes are made sufficiently tight to preclude separation of the tubes during the process of winding the tube assembly on drum 40.

The illustrated take-up reel 18 is of relatively low cost construction that is particularly suited for rotatably supporting the light weight plastic tubing assembly 26. The revolving drum portion 40 of the reel is supported ion the circular openings in side members 42, and there is no requirement for special bearings or drum-support shafts. Crank element 60 is attached directly to one of the end caps 58. The upstanding side members 42 have flat lower edges that form integral feet, whereby the reel structure is stably supported on a ground surface or floor surface during use or during storage periods. The side members of the reel are used to confine the plastic tubing, and also as devices for suspending or holding the golf clubs, balls and related equipment.

Although the present invention has been described in considerable detail with reference to certain preferred versions, many other versions should be apparent to those skilled in the art. Therefore, the spirit and scope of the appended claims should not necessarily be limited to the description of the preferred versions contained therein.

Thus there has been shown and described a novel golf game which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A golf game comprising:

a flag, at least one ball, at least one golf club, a flexible tube assembly comprising a plurality of flexible, hollow elongated tubular members of selected respective lengths, each elongated member having a first male end and a second mating female end, whereby each elongated member may be disposed in an endless target area-defining ring adjustable to selected configuration by connecting its male end to its female end, and a take-up reel comprising a frame, a revolving drum rotatably mounted in the frame, and an anchorage on the drum for one end of a tubular member, and wherein at least some of said tubular members are of different lengths, whereby the respective tubular members are formable into respective endless target units of different circumscribed areas of adjustable selected configurations, said tubular members are interconnectable to form a flexible tube assembly of a length that is the summation of the lengths of the tubular members, said flexible tube assembly has an end attachable to said anchorage on the drum, whereby the drum is rotatable to wind the assembly on the drum, and the male and female ends of each elongated tubular member are so configured that the connections between the tubular members provide smooth continuations of the tubular surfaces, whereby the flexible assembly can be drawn onto the drum without being obstructed by said connections.

2. A game according to claim 1, wherein:

the frame of said take-up reel comprises two upstanding side members with aligned circular holes therein, said revolving drum comprises a hollow cylinder extending through the aligned circular holes, whereby the holes form bearing surfaces for rotatably supporting the drum, said revolving drum further comprises end caps extending across the ends of said hollow cylinder, and a knob extends from one of said end caps at a point offset from the drum axis, whereby said knob forms a crank for rotating the drum,

3. A game according to claim 2, and further comprising:

clip means on one of said side members for supporting at least one golf club in a horizontal prone position.

4. A game according to claim 2, and further comprising:

a carrying handle for said take-up reel, said carrying handle comprising a bar extending between said upstanding side members directly above the rotational axis of the revolving drum, whereby the weight of the take-up reel is balanced while it is being carried from one location to another location.

5. A game according to claim 2, and further comprising:

ball container means supported on one of said upstanding side members.

6. A game according to claim 2, wherein:

said upstanding side members of the take-up reel have integral feet for supporting the reel on a ground surface while the drum is revolving.

7. A game according to claim 1, wherein:

said revolving drum comprises a cylindrical support surface for the flexible tube assembly, and said anchorage comprises a cylindrical plug spaced a slight distance from the cylindrical support surface, whereby one end of the flexible tube assembly can be telescoped over said plug so that the respective tubular member lies flat against the support surface.

8. A game according to claim 1, wherein:

the male end of each tubular member has a ribbed side surface for gripping engagement with the female end of an associated tubular member.

* * * * *